US006082260A

United States Patent [19]

Friedrichs et al.

[11] Patent Number: 6,082,260

[45] Date of Patent: Jul. 4, 2000

[54] TRANSFER DRUM IN A SHEET-PROCESSING PRINTING PRESS

[75] Inventors: Jens Friedrichs; Frank Schaum, both of Heidelberg; Peter Heiler, Forst; Stefan Döpke, deceased, late of Rehburg-Loccum, by Franz-Adolp Döpke, heir; by Katrin Ewert, heir, Jügesheim-Rodgau, all of Germany

[73] Assignee: Heidelberger Druckmaschinen AG, Heidelberg, Germany

[21] Appl. No.: 08/961,896

[22] Filed: Oct. 31, 1997

[30] Foreign Application Priority Data

Oct. 31, 1996 [DE] Germany ..... 196 44 011

[51] Int. Cl.[7] ..... B41F 1/28

[52] U.S. Cl. ..... 101/232; 101/409; 271/277

[58] Field of Search ..... 101/230, 232, 101/407.1, 408, 409, 410; 271/277

[56] References Cited

U.S. PATENT DOCUMENTS

| | | | |
|---|---|---|---|
| 3,654,861 | 4/1972 | Rudolph et al. | 101/409 |
| 3,839,959 | 10/1974 | Abendroth | 101/409 |
| 3,937,142 | 2/1976 | Cerny et al. | 101/409 |
| 4,202,268 | 5/1980 | Becker | 101/232 |
| 4,204,471 | 5/1980 | Becker | 101/410 |
| 4,336,930 | 6/1982 | Cerny et al. | 271/277 |
| 4,735,142 | 4/1988 | Haupenthal | 101/410 |
| 5,362,043 | 11/1994 | Grellman | 101/409 |
| 5,579,691 | 12/1996 | Voge | 101/410 |
| 5,617,791 | 4/1997 | Fürbass | 101/232 |
| 5,762,333 | 6/1998 | Sugiyama et al. | 101/410 |

FOREIGN PATENT DOCUMENTS

| | | |
|---|---|---|
| 1761714 | 10/1973 | Germany . |
| 8611832 | 12/1988 | Germany . |
| 3929228A1 | 3/1991 | Germany . |

*Primary Examiner*—Eugene Eickholt
*Attorney, Agent, or Firm*—Herbert L. Lerner; Laurence A. Greenberg

[57] ABSTRACT

A transfer drum in a sheet-fed printing press having a support surface formed at least segmentally of individual punctiform support elements disposed on the circumference of the transfer drum includes another support surface disposed at least segmentally on the circumference of the transfer drum, the other support surface being continuous, both of the support surfaces being mutually interchangeable.

14 Claims, 6 Drawing Sheets

TRANSFER DRUM IN A SHEET-PROCESSING PRINTING PRESS

BACKGROUND OF THE INVENTION

Field of the Invention

The invention relates to a transfer drum in a sheet-processing or sheet-fed printing press having a support surface formed at least segmentally of individual punctiform support elements disposed on the circumference of the transfer drum.

When thicknesses of paper are being processed in sheet-processing printing presses, especially in a perfector printing operation, smearing problems occur with freshly printed sheets on the transfer drum.

To avoid this smearing problem, it has become known heretofore, for example, from the published German Patent Document DE 39 29 228 A1, to dispose, on a shaft support, brackets having punctiform support elements corresponding to the circumference of the sheet transfer drum, when cardboard or pasteboard is being processed. Due to these measures, the sheet rests on the support elements only in adjustable regions. When thin paper is being processed, support brackets with smaller circumferential dimensions are provided. A disadvantage of the construction according to the aforementioned published German Patent Document DE 39 29 228 A1 is that the support elements are used both when cardboard is being printed and when thin paper is being printed. Consequently, air turbulence, especially when thin paper is being printed, causes undesired fluttering of the sheets and leads to sheet guidance problems which impair the quality of the printed products.

SUMMARY OF THE INVENTION

It is accordingly an object of the invention to provide a sheet transfer drum having a surface adaptable to the material to be processed.

With the foregoing and other objects in view, there is provided, in accordance with the invention, a transfer drum in a sheet-fed printing press having a support surface formed at least segmentally of individual punctiform support elements disposed on the circumference of the transfer drum, comprising another support surface disposed at least segmentally on the circumference of the transfer drum, the other support surface being continuous, both of the support surfaces being mutually interchangeable.

In accordance with another feature of the invention, the closed support surface is formed as a surface covering, the punctiform support elements and the closed support surface being respectively disposed so as to be bringable into an "operating position" and a "rest position", respectively.

In accordance with another feature of the invention, the surface covering is pivotally supported on the transfer drum.

In accordance with a further feature of the invention, the transfer drum includes a locking element for locking the surface covering in the "rest position", the locking element being disposed inside the circumference of the transfer drum.

In accordance with an added feature of the invention, the locking element is a locking lever formed with a stop edge and being pivotally supported on a lateral structure of the sheet transfer drum.

In accordance with an additional feature of the invention, the surface covering is pivotable and rotatably supports a roller bringable into contact with the stop edge formed on the pivotable locking lever.

In accordance with yet another feature of the invention, the transfer drum includes a restoring spring supported at one end thereof on the surface covering and at the other end thereof on the locking lever.

In accordance with yet a further feature of the invention, the transfer drum includes an adjusting element carrying the surface covering, the adjusting element being pivotal about a pivot location outside the surface covering and inside the circumference of the sheet transfer drum.

In accordance with yet an added feature of the invention, the support elements and the surface covering are disposed on a common carrier body so that the "rest position" of the support elements corresponds to the "operating position" of the surface covering, and the reverse.

In accordance with yet an additional feature of the invention, both the support elements and the surface covering are pivotally supported on the sheet transfer drum.

In accordance with still another feature of the invention, the transfer drum includes an endless carrier whereon the support elements and the surface covering are jointly disposed.

In accordance with still a further feature of the invention, the endless carrier is a belt or a chain.

In accordance with still an added feature of the invention, the transfer drum includes guides for guiding the endless carrier, the guides being secured to lateral structures of the sheet transfer drum.

In accordance with a concomitant feature of the invention, the support elements are formed as rowels, and the transfer drum has a supporting cylinder shaft, the surface covering being disposed, in a rest position, between the cylinder shaft and the rowels inside the circumference of the sheet transfer drum and, in an operating position, lying on the rowels.

It is an advantage of the invention that the various demands that are made upon sheet guidance in processing a broad range of materials, from thin paper through cardboard, can be met without any major expenditure in setup or make-ready effort.

In an advantageous embodiment, for example, a surface covering that is used in processing thin paper, for example, is no longer required to be removed from the printing press and, instead, can be lowered directly into the "rest position" inside the periphery of the transfer drum and locked thereat.

In a preferred version, the surface covering is advantageously secured to a pivotally supported lever. A further resiliently supported locking lever locks the surface covering in the "rest position". A restoring spring brings the surface covering into an "operating position" and, simultaneously, serves to provide the restoring motion of the locking lever.

In a second exemplary embodiment, in an especially inexpensive version, the punctiform support surface formed of rowels is also left in the "operating position" in the sheet transfer drum upon activation of the continuous surface covering. In this manner, an operator has the requisite circumferential surfaces readily available, directly on the sheet transfer drum.

In a third exemplary embodiment, an extraordinarily compact construction of the support elements is provided, wherein the rowels and the surface covering are disposed on a common carrier body. The carrier body is detachably secured to the sheet transfer drum and can be shifted in position in such a manner that the "rest position" of the surface covering is the "operating position" of the rowels, and the reverse.

In a fourth exemplary embodiment, both the rowels and the surface covering are pivotally supported on the sheet transfer drum. As a result of this provision, the support elements are always connected to the sheet transfer drum and need not be removed from the printing press at all.

In a fifth exemplary embodiment, the support elements again remain advantageously supported on the sheet transfer drum at all times by being disposed on a common endless carrier element, such as a belt or chain, which is displaceable through the intermediary of guides which are provided in a manner that, as required, either the punctiform support elements, for example, the rowels, or the surface support elements, such as the surface covering, for example, are bringable into the "operating position" and the "rest position", respectively.

Other features which are considered as characteristic for the invention are set forth in the appended claims.

Although the invention is illustrated and described herein as embodied in a transfer drum in a sheet-processing printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
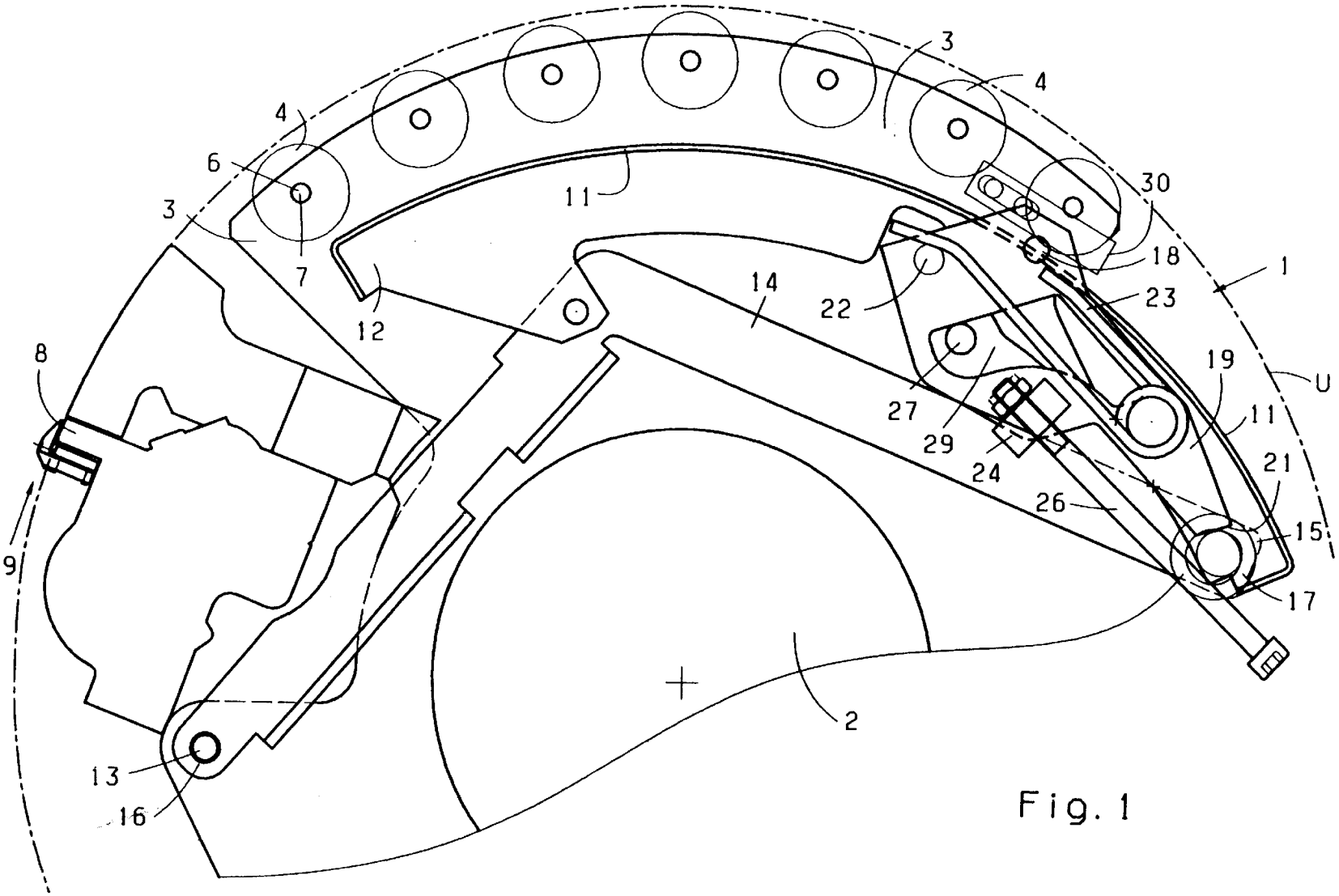
FIG. 1 is a fragmentary, diagrammatic side elevational view of a sheet transfer drum provided with a locking device according to a first exemplary embodiment of the invention and being shown in an operating phase thereof wherein a surface covering for the sheet transfer drum is in a rest position.
Figure 2:
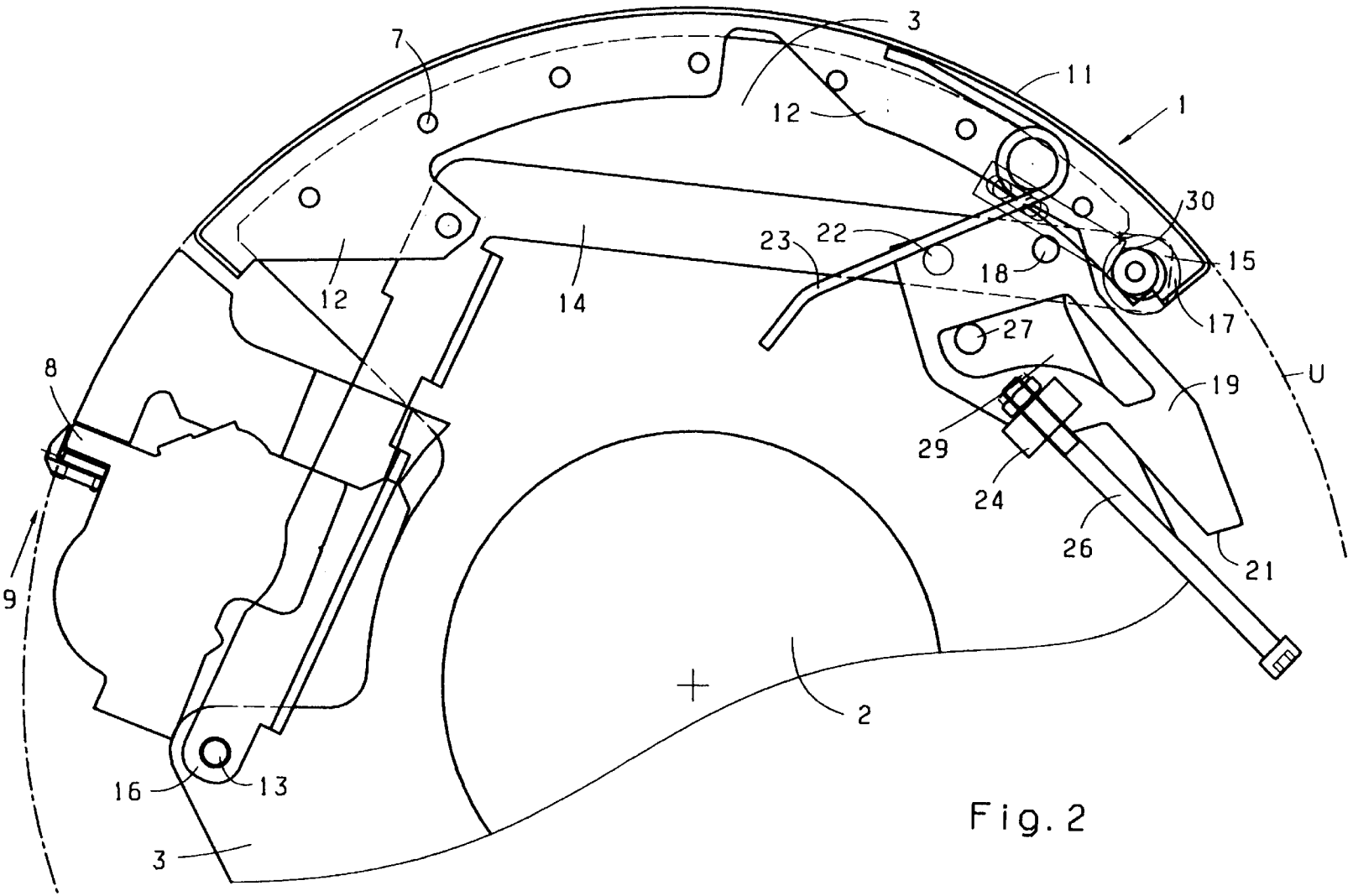
FIG. 2 is a view like that of FIG. 1 of the first exemplary embodiment of the sheet transfer drum provided with the locking device, but being shown, however, in an operating phase thereof wherein the surface covering for the sheet transfer drum is in operating position.

Referring now to the drawings and, first, particularly to FIG. 1 thereof, there is shown therein a sheet transfer drum 1 including, among other elements, a cylinder shaft 2, by which the transfer drum 1 is supported in non-illustrated side frames of a sheet-fed printing press, and lateral structures 3 which are fastened to the shaft 2 within the side frames of the printing press and carry support elements 4. The support elements 4 are so-called rowels, which are like tail wheels, a number of which are lined up adjacent to one another and supported on respective shafts 6. The shafts 6 are removably disposed in bores 7 formed in the lateral structures 3 of the transfer drum 1 and extend axially parallel from one lateral structure 3 of the sheet transfer drum 1 to the other. In order to gain a larger support region for the sheets to be transported, a number of the shafts 6, such as seven thereof, for example, with rowels 4 disposed thereon so that they are axially displaceable are arranged in parallel, at a distance from the cylinder shaft 2, so that with the radially outwardly-oriented circumferences thereof, they form the total circumference U of the sheet transfer drum 1. This circumference is substantially equivalent to the circumference defined by a gripper pad 8. The transfer drum 1, in the exemplary embodiment of FIG. 1, is a double-size drum, i.e., as noted hereinbefore, having twice the circumference of the conventional printing-unit cylinders, namely the blanket, impression and form cylinders, with two diametrically opposed gripper systems 9. Because of this symmetry, in the interest of simplicity, the invention is described hereinafter with regard to only half of the drum.

In addition to the rowels 4, a surface covering 11 is provided, which has a curvature corresponding to that of the circumference U. The surface covering 11 has side walls 12, disposed parallel to the lateral structures 3 of the sheet transfer drum 1. The side walls 12 are respectively fastened to a respective bell crank 14. The respective bell crank 14 is supported by an end 16 thereof on a respective lateral structure 3 so as to be pivotable about a bolt 13, and carries on a free end 15 thereof a rotatably supported or journalled roller 17.

A locking lever 19 is pivotally supported at a bearing location on the respective lateral structure 3. The locking lever 19 is formed with a stop edge 21 for the roller 17, and an abutment 22 for a restoring spring 23 disposed on the surface covering 11. The restoring spring 23 is constructed as a torsional spiral spring and is supported by a first leg thereof below the surface covering 11 and by a second leg thereof on the abutment 22 of the locking lever 19. The locking levers 19 disposed on both sides have a crossbar 24, for synchronizing a pivoting motion which, approximately axially in the middle thereof, carries an adjusting lever 26 which protrudes sufficiently beyond a front edge of the surface covering 11 so as to be easily actuatable. A stop bolt 27 disposed on the lateral structure 3 extends through an opening 29 formed in the locking lever 19 and engages the latter due to the tension of the restoring spring 23.

When cardboard, for example, is being processed, the rowels 4 are activated, and the surface covering 11 is located in the detent position, as shown in FIG. 1, below the circumference U. The roller 17 then rests on the stop edge 21 which is inclined in such a way that the roller 17 is unable to pivot outwardly on its own. If a conversion from rowel operation to surface covering operation is to be made, for example, for processing thin paper, the rowels 4 together with the shafts 6 are initially removed. The locking lever 19 is then actuated. In this regard, through the intermediary of the adjusting lever 26, a pivoting motion of the locking lever 19 counter to the force of the restoring spring 23 is produced, which releases the roller 17. The bell crank 14, via the roller 17, is then initially pivoted counter to the intended adjusting direction about the bearing location 13 on the lateral structure 3. Because the distance between the bearing location 13 and the roller 17 is greater than the distance between a bearing location 18 of the locking lever 19 and the stop edge 21, and because the two elements, namely the stop edge 21 and the roller 17, are moving on different paths, the roller 17 is released or freed from the stop edge 21.

Due to the force of the restoring springs 23, the surface covering 11 secured to the bell cranks 14 is pivoted outwardly about the bolt 13 as far as the circumference U.

The roller 17 then strikes a stop 30 which is secured to the lateral structure 3 and is supported so as to be displaceable for effecting an adjustment thereof. The circumference U of the sheet transfer drum 1, which is predetermined by the surface covering 11, is adjustable by the adjustment of the stop 30.

For processing cardboard, for example, the surface covering 11 is pressed inwardly, counter to the force of the restoring spring 23, until the roller 17 locks into place behind the stop edge 21 of the locking lever 19. The pivot location 13 of the surface covering 11 is located outside the surface covering 11, but inside the circumference U far enough that the surface covering 11 is lowered all the way into the circumference U.

Figure 3:
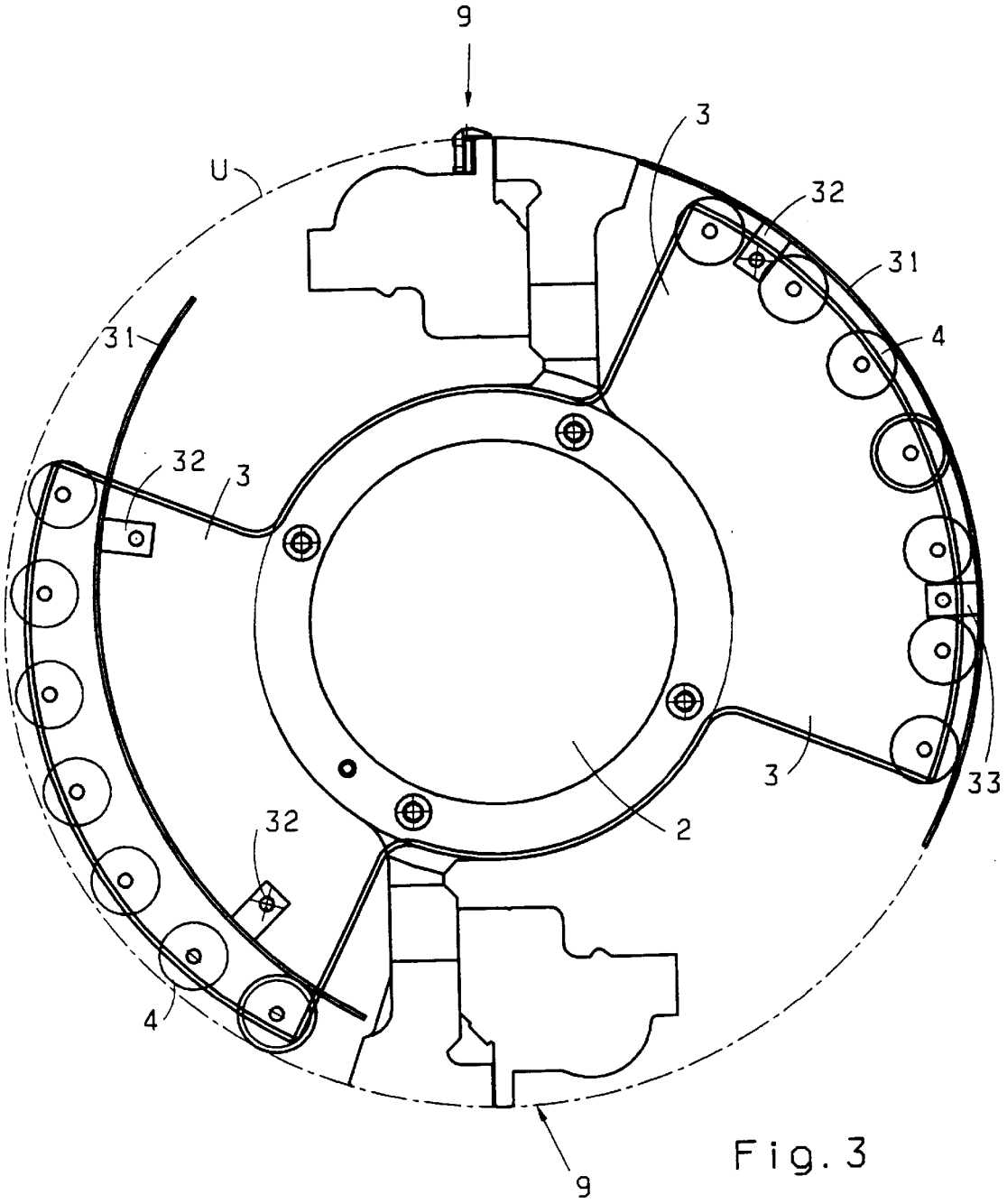
FIG. 3 is a diagrammatic side elevational view of a second exemplary embodiment of the invention, wherein the sheet transfer drum is of the so-called double size, i.e., it has twice the circumference of a conventional printing-unit cylinder, the right-hand half thereof showing the surface covering in "rest position", and the left-hand half thereof in "operating position"

In a second exemplary embodiment shown in FIG. 3 a surface covering 31 is used which again has a curvature adapted to the circumference U of the sheet transfer drum 1. Fastening elements 32 and 33 disposed laterally on the surface covering 31 serve to lock the surface covering 31 to the respective lateral structure 3. In an "operating position" for processing thin paper, the surface covering 31 rests on the rowels 4. In a "rest position", the surface covering 31 is located between the cylinder shaft 2 and the rowels 4, inside the periphery of the sheet transfer drum 1. In both cases, the surface covering 31 is secured to the lateral structure 3 by the fastening elements 32 and 33.

Figure 4:
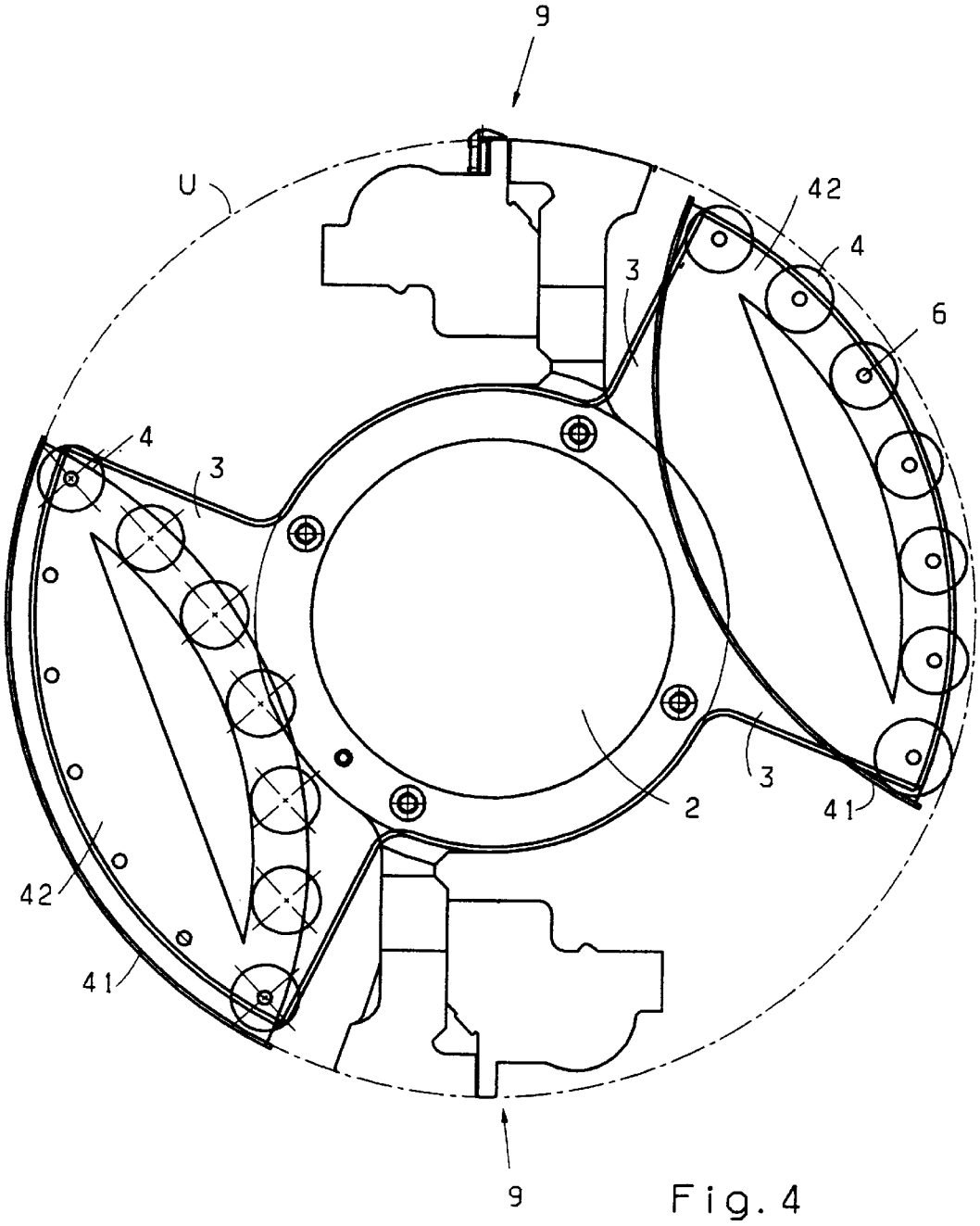
FIG. 4 is a view similar to that of FIG. 3 of a third exemplary embodiment of the invention with the right-hand and the left-hand halves thereof showing the surface coverings in "rest" and "operating" positions, respectively.

In a third exemplary embodiment according to FIG. 4, the rowels 4 and a surface covering 41 are disposed on a common carrier body 42 having two support regions for a sheet, one thereof being formed by the rowels 4, and the other thereof being formed by the surface covering 41. Both support regions are disposed opposite one another in precise mirror symmetry, so that only one at a time is in the "operating position", while the other is in the "rest position". Releasable fastening devices fix the support bodies 42 in the desired position on the respective lateral structure 3.

Figure 5:
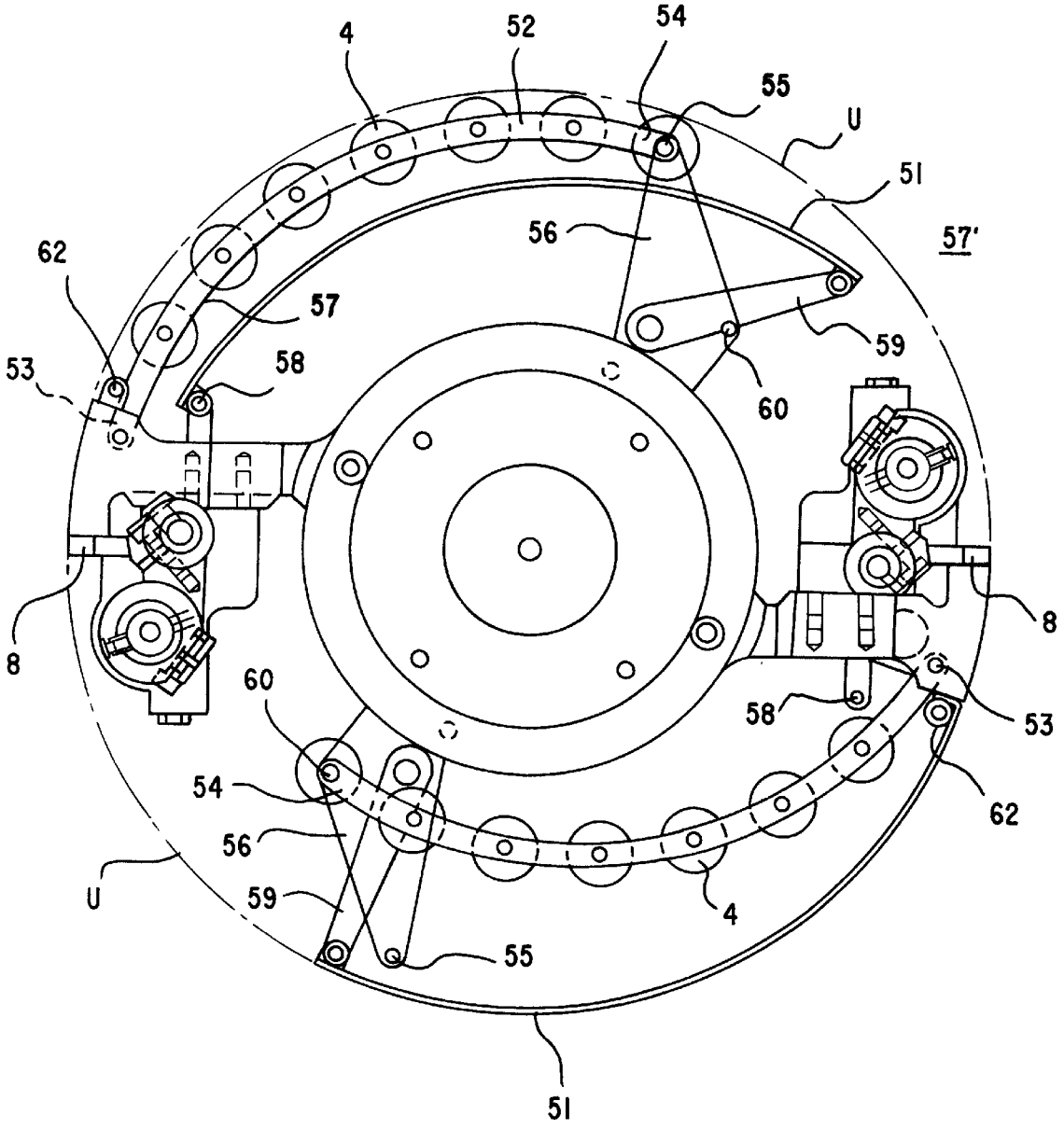
FIG. 5 is a view similar to those of FIGS. 3 and 4 of a fourth exemplary embodiment of the invention with the upper and lower halves thereof showing the surface coverings in "rest" and "operating" positions, respectively.

In a fourth exemplary embodiment according to FIG. 5, both the rowels 4 and the surface covering 51 are disposed on a gripper bar of the gripper system 9. In an operative position of the rowels 4 and a rest position of the surface covering 51, the rowels 4 are carried on a support bracket 52 which is supported by a first end 53 thereof on the gripper bar of the gripper system 9 and by a second end 54 thereof on a bearing location 55 of a bracket 56 which is secured to the shaft 2. The surface covering 51 is pivotally supported by a first end 57 thereof on a bearing location 58 of the gripper bar of the gripper system 9 and by a second end 57' thereof on a lever 59. The lever 59 is pivotally disposed on the bracket 56. For processing thin paper, for example, the surface covering 51 is placed into the operating position and the rowels 4 are placed into the rest position. In this regard, the support bracket 52 is initially released from the bearing location 55 of the bracket 56. Then, the end of the surface covering 51 is released from the bearing location 58 on the gripper bar of the gripper system 9. The support bracket 52 and the surface covering 51 are, respectively, pivoted outwardly about the respective second bearing location thereof and then, in reverse order, pivoted back inwardly again. Thereafter, the support bracket 52 is initially locked on a bearing location 60 of the carrier 56, and the surface covering 51 is then locked on a bearing location 62 on the gripper bar of the gripper system 9. The lever 59 thereby pivots into a radial position, so that the surface covering 61 forms the circumference U.

Figure 6:
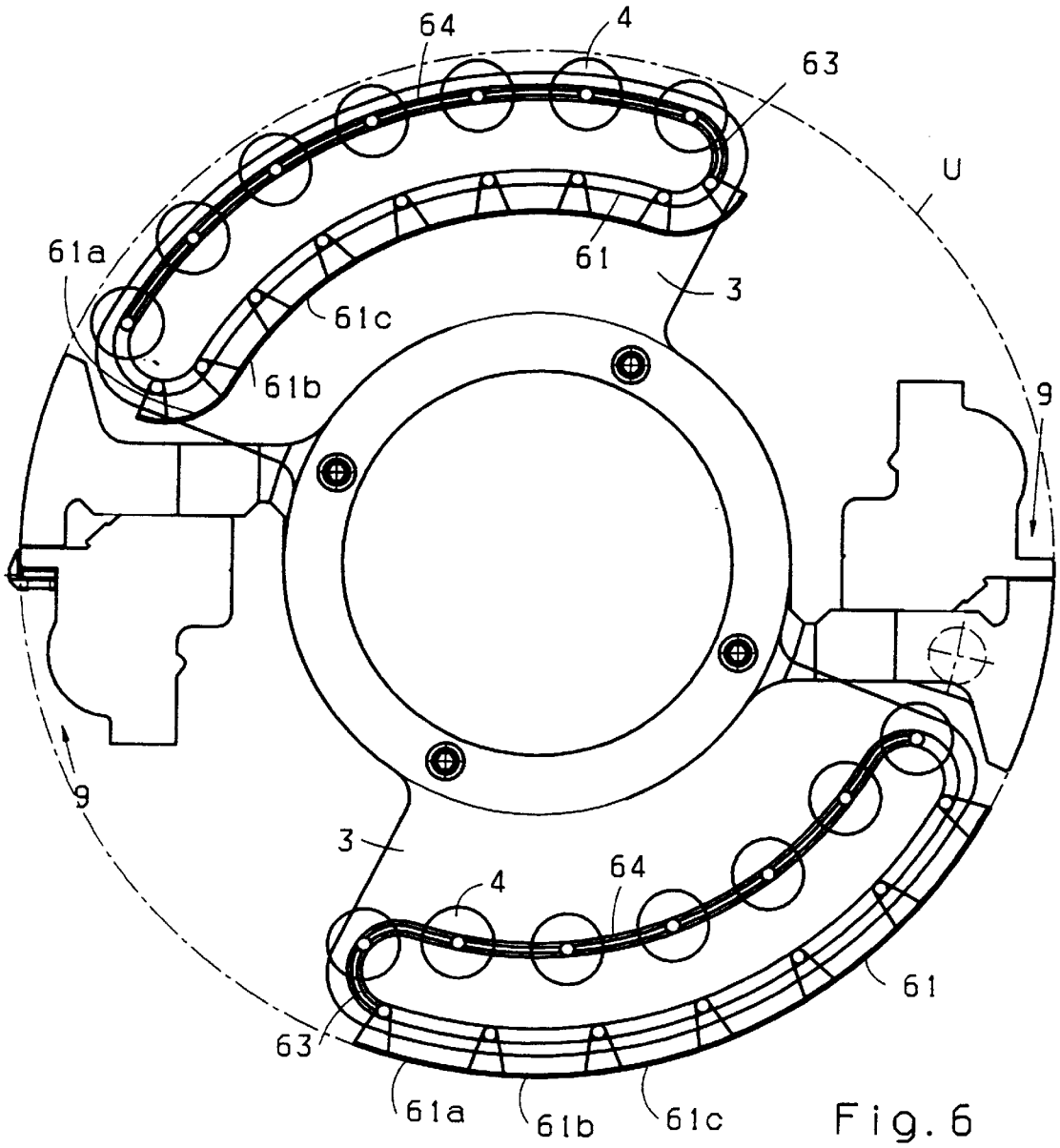
FIG. 6 is a view similar to those of FIGS. 3, 4 and 5 of a fifth exemplary embodiment of the invention with the upper and lower halves thereof showing the surface coverings in "rest" and "operating" positions, respectively.

In a fifth exemplary embodiment according to FIG. 6, the rowels 4 and the surface covering 61 are disposed in tandem, i.e., after one another, on an endless belt or chain 63. A guide 64 in which the belt or chain 63 is guided is provided on the lateral structures 3. In this exemplary embodiment, the surface covering 61 is formed of a number of plates 61*a*, 61*b*, 61*c*, and so forth, articulatedly connected to one another or an elastic foil or a cloth or the like.

For bringing the surface covering 61 from a rest position into an operating position, the rowels 4, after being released from a non-illustrated lock, are displaced a distance upwardly in the guide 64 so that they come to rest inside the periphery of the sheet transfer drum 1, and the surface covering 61 forms the circumference U of the sheet transfer drum 1.

Because the sheet transfer drum 1 is constructed essentially mirror-symmetrically, the description of the foregoing exemplary embodiments, in the interest of simplicity, has been limited to only one side thereof, in accordance with the respective figures of the drawings. It is of course to be understood that the support elements, such as the rowels 4 and the surface coverings 11, 31, 41, 51 and 61 extend from one side of the sheet transfer drum 1 to the other.

We claim:

1. A transfer drum in a sheet-fed printing press having a support surface formed at least segmentally of individual punctiform support elements disposed on the circumference of the transfer drum, comprising another support surface disposed at least segmentally on the circumference of the transfer drum, said other support surface being continuous, both of said support surfaces being mutually interchangeable.

2. The transfer drum according to claim 1, wherein said continuous support surface is formed as a surface covering, the punctiform support elements and said continuous support surface being respectively disposed so as to be bringable into an "operating position" and a "rest position", respectively.

3. The transfer drum according to claim 2, wherein said surface covering is pivotally supported on the transfer drum.

4. The transfer drum according to claim 2, including a locking element for locking said surface covering in said "rest position", said locking element being disposed inside the circumference of the transfer drum.

5. The transfer drum according to claim 4, wherein said locking element is a locking lever formed with a stop edge and being pivotally supported on a lateral structure of the sheet transfer drum.

6. The transfer drum according to claim 5, wherein said surface covering is pivotable and rotatably supports a roller bringable into contact with said stop edge formed on said pivotable locking lever.

7. The transfer drum according to claim 5, including a restoring spring supported at one end thereof on said surface covering and at the other end thereof on said locking lever.

8. The transfer drum according to claim 2, including an adjusting element carrying said surface covering, said adjusting element being pivotable about a pivot location outside said surface covering and inside the circumference of the sheet transfer drum.

9. The transfer drum according to claim 2, wherein the support elements and said surface covering are disposed on a common carrier body so that said "rest position" of the support elements corresponds to said "operating position" of said surface covering, and the reverse.

10. The transfer drum according to claim 1, wherein both the support elements and said continuous support surface are pivotally supported on the sheet transfer drum.

11. The transfer drum according to claim 1, including an endless carrier whereon the support elements and said continuous support surface are jointly disposed.

12. The transfer drum according to claim 11, wherein said endless carrier is one of a belt and chain.

13. The transfer drum according to claim 12, including guides for guiding said endless carrier, said guides being secured to lateral structures of the sheet transfer drum.

14. The transfer drum according to claim 2, wherein the support elements are formed as rowels, and the transfer drum has a supporting cylinder shaft, said surface covering being disposed, in a rest position, between said cylinder shaft and said rowels inside the circumference of the sheet transfer drum and, in an operating position, lying on said rowels.

* * * * *